US007857502B2

(12) United States Patent
Rochat

(10) Patent No.: US 7,857,502 B2
(45) Date of Patent: Dec. 28, 2010

(54) SELF-WINDING WATCH INCLUDING AN INDICATOR OF THE POWER RESERVE

(75) Inventor: Marco Rochat, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 146 days.

(21) Appl. No.: 12/280,022

(22) PCT Filed: Feb. 7, 2007

(86) PCT No.: PCT/CH2007/000058

§ 371 (c)(1),
(2), (4) Date: Jan. 26, 2009

(87) PCT Pub. No.: WO2007/095767

PCT Pub. Date: Aug. 30, 2007

(65) Prior Publication Data

US 2009/0129211 A1 May 21, 2009

(30) Foreign Application Priority Data

Feb. 22, 2006 (EP) ..... 06003562

(51) Int. Cl.
*G04B 9/00* (2006.01)
*G04B 5/02* (2006.01)

(52) U.S. Cl. ..... 368/212; 368/208; 368/203; 368/148

(58) Field of Classification Search ..... 368/66, 368/140, 206–208, 210, 212, 145, 147, 148
See application file for complete search history.

(56) References Cited

U.S. PATENT DOCUMENTS 663,263 A * 12/1900 Elenius ..... 368/210
1,173,466 A * 2/1916 Teske ..... 368/212
1,973,898 A * 9/1934 Georges ..... 368/148
2,774,252 A 12/1956 Meyer
3,412,550 A * 11/1968 Delessert et al. ..... 368/208
5,828,628 A * 10/1998 Born et al. ..... 368/66
6,678,216 B2 * 1/2004 Takahashi ..... 368/66
6,685,352 B1 2/2004 Capt et al.
7,170,825 B2 * 1/2007 Takahashi ..... 368/66
7,527,423 B2 * 5/2009 Ruchonnet et al. ..... 368/127
2005/0243652 A1 * 11/2005 Taillard et al. ..... 368/35
2006/0239124 A1 * 10/2006 Thumm ..... 368/88

FOREIGN PATENT DOCUMENTS

CH 301497 11/1954
EP 1 074 897 A1 2/2001
FR 1.066.074 6/1954

OTHER PUBLICATIONS

International Search Report issued in corresponding application No. PCT/CH2007/000058, completed Sep. 7, 2007 and mailed Sep. 25, 2007.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The present invention relates to a self-winding watch including an oscillating mass (8), the movements of which are transmitted to a spring barrel of the watch, this watch likewise including a device for indicating the power reserve comprising means (2) for displaying the power reserve, characterised in that the means (2) for displaying the power reserve are mounted on the oscillating mass (8).

8 Claims, 1 Drawing Sheet

SELF-WINDING WATCH INCLUDING AN INDICATOR OF THE POWER RESERVE

This is a National Phase Application in the United States of International Patent Application No. PCT/CH2007/000058 filed Feb. 7, 2007, which claims priority on European Patent Application No. 06003562.3, filed Feb. 22, 2006. The entire disclosures of the above patent applications are hereby incorporated by reference.

FIELD OF THE INVENTION

The present invention relates to a self-winding watch including an indicator of the power reserve.

BACKGROUND OF THE INVENTION

In a self-winding watch, the movements of the wearer are transmitted to the spring barrel by means of an oscillating mass and a reduction mechanism. This mass can be fixed to the centre of the movement or possibly off-centre. Generally the self-winding mechanism is placed above the movement, on the bridge side. However it frequently happens likewise that the oscillating mass is disposed below the movement. The works of the self-winding mechanism are composed of toothed elements, which make it possible to transmit the force from the oscillating mass to the ratchet and to wind up the spring barrel. The works of this self-winding mechanism are composed generally of the following elements: pinion of the oscillating mass, intermediate direction-adjusting moving elements, reduction and ratchet moving elements. The works of the self-winding mechanism are composed in general of a gear mechanism part and a stepping down mechanism part, also termed reduction mechanism. It is the latter which has the object of reducing the initial speed of the oscillating mass and of increasing the force intended for winding up the spring barrel.

Certain manufacturers provide self-winding watches with a device for indicating the power reserve, i.e. a device which makes it possible for the wearer to know at any time the number of hours during which the watch will still function without being wound up. The power reserve is then indicated either by a disc carrying numbers, one of which is visible through a window, or by means of a needle which is displaced above a supplementary graduation.

The combination of a self-winding mechanism with an indicator of the power reserve is reserved more for expensive watches, normally termed smart watches. Such watches can comprise, apart from the mechanism for displaying the power reserve, a stop-watch, a day of the month mechanism, a mechanism indicating phases of the moon or others, so that the space available on the face of such watches for indicating the power reserve is reduced.

The object of the present invention is to remedy this disadvantage by providing the mechanism for indicating the power reserve at a place on the watch where more space is available.

SUMMARY OF THE INVENTION

To this end, the present invention relates to a self-winding watch including an oscillating mass, the movements of which are transmitted to a spring barrel of the watch, this watch likewise including a device for indicating the power reserve comprising means for displaying the power reserve, characterised in that the means for displaying the power reserve are mounted on the oscillating mass.

Thanks to these features, the present invention provides a self-winding timepiece including a mechanism for indicating the power reserve, the means of which for displaying the power reserve are carried by the oscillating mass. By taking this route, space is freed up on the face of the watch, which makes it possible to display time information or information not connected to the time in a more readable manner or to add supplementary indicators. Furthermore, as the oscillating masses are often of a large size, this makes it possible to display information relating to the power reserve in a more readable manner.

According to another feature of the invention, the self-winding watch includes a differential mechanism with two inputs and one output, a first input being formed by a gear wheel which is connected kinematically to the device for indicating the power reserve, whilst the second input is formed by a mechanism which compensates for the rotation of the display means of the device for indicating the power reserve caused by the rotation of the oscillating mass, the output of the differential mechanism being formed by the means for displaying the power reserve.

Thanks to these other features, the relative position of the means for displaying the power reserve relative to the oscillating mass remains unchanged when the latter turns, except of course as far as displacements of the display means, which are inherent to the loading/unloading of the spring barrel are concerned.

In other words, in accordance with a first embodiment of the present invention, a self-winding watch is provided that includes an oscillating mass (8), the movements of which are transmitted to a spring barrel of the watch, this watch likewise including a device for indicating the power reserve including means (2) for displaying the power reserve, characterised in that the means (2) for displaying the power reserve are mounted on the oscillating mass (8). In accordance with a second embodiment of the present invention, the first embodiment is modified so that it includes a differential mechanism (6) with two inputs and one output, a first input being formed by a gear wheel which is connected kinematically to the device for indicating the power reserve, whilst the second input is formed by a mechanism which compensates for the rotation of the display means (2) of the device for indicating the power reserve caused by the rotation of the oscillating mass, the output of the differential mechanism (6) being formed by the means (2) for displaying the power reserve. In accordance with a third embodiment of the invention, the second embodiment is further modified so that the gear ratios of the gear wheel, on the one hand, and of the compensation mechanism, on the other hand, are equal and of opposite signs. In accordance with a fourth embodiment of the invention, the third embodiment is further modified so that the differential mechanism (6) includes a wheel (10) which is mounted freely about an axle (14) which carries, at one of its ends, the means (2) for displaying the power reserve, the wheel (10) engaging with the gear wheel (4) and carrying a satellite moving element (16) which causes rotation of the axle (14), the differential mechanism (6) including furthermore an input moving element (26) which is in engagement with an input crown (32) which is fixed, on the one hand, and which is caused to rotate by the oscillating mass (8) when the latter turns, on the other hand, the input moving element (26) causes, for its part, rotation of the differential axle (14). In accordance with a fifth embodiment of the present invention, the first embodiment, the second embodiment, the third embodiment, and the fourth embodiment, are further modified so that the display means (2) of the device for indicating the power reserve comprise a needle (2).

BRIEF DESCRIPTION OF THE DRAWINGS

Other features and advantages of the present invention will emerge more clearly from the following detailed description of an embodiment of the watch according to the invention, this example being given purely by way of illustration and in a non-limiting manner, solely in connection with the annexed drawing in which.

DETAILED DESCRIPTION OF THE ILLUSTRATIVE EMBODIMENTS

Figure 1:
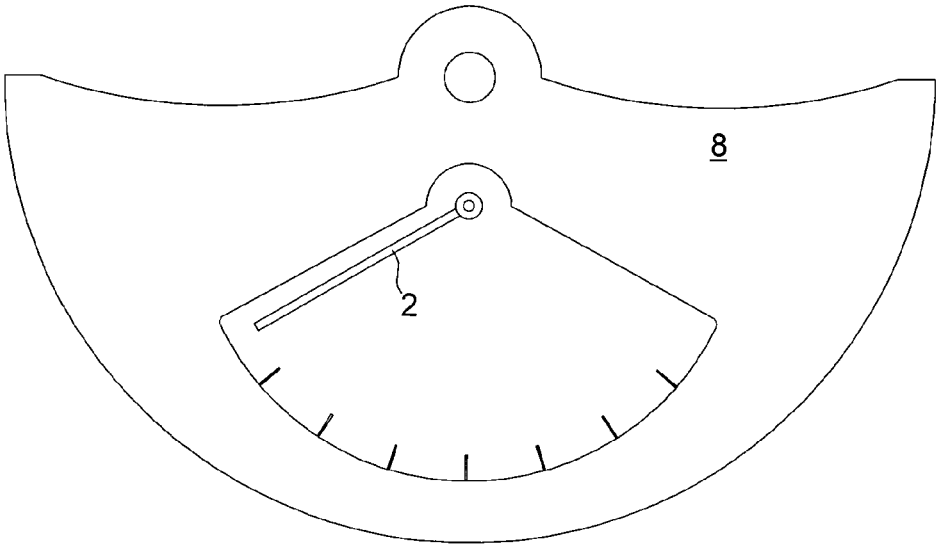
FIG. 1 is a view from above of an oscillating mass carrying means for indicating the power reserve according to the invention.

The present invention starts from the general inventive concept, which comprises accommodating the means for displaying a device for indicating the power reserve in the oscillating mass of a self-winding watch. In this scenario, space is freed up on the face of the watch for displaying more information or information, which is in a more readable manner on this face, whilst because of the dimensions of the oscillating mass it is likewise easier to read the indicator relating to the power reserve.

The present invention will be described in connection with the display means for indicating the power reserve with a needle. It goes without saying that this example is given purely by way of illustration and only in a non-limiting manner and that the invention can be applied in an analogous manner to an indicator of the power reserve by means of a disc. It will likewise be noted that the invention is applied equally to an oscillating mass situated below or above the movement of the watch.

The device for indicating the power reserve, designated in its entirety by the general reference number 1, includes as standard a mechanism which connects a spring barrel of the watch (not shown) kinematically to means for displaying the power reserve such as a needle 2. Only an output gear 4 of the device for indicating the power reserve 1 is represented in the drawing. This output gear 4 turns slowly in clockwise or anticlockwise direction according to whether the spring barrel is being wound up or winding down. For the needs of the present invention, it will be assumed that this output gear 4 is substantially immobile and constitutes one of the inputs of a differential mechanism 6.

By turning about an axle X-X, the oscillating mass 8 drives with it a differential wheel 10 that is mounted freely via a bearing 12 about a differential axle 14 that carries, at its free end, the needle 2 for indicating the power reserve. The differential wheel 10 carries a satellite moving element 16 formed by a satellite wheel 18, which is itself mounted on a satellite pinion 20. The satellite wheel 18 and satellite pinion 20 assembly is free in rotation about a pin 22 which is mounted in the differential wheel 10. Hence, when the differential wheel 10 turns, it moves over the output gear 4 of the device 1 for indicating the power reserve and causes the satellite wheel 18 to rotate. The latter engages, for its part, with a differential pinion 24 fixed on the differential axle 14. By allowing the gear ratio for actuation of the differential axle to be equal to 1, the needle 2 for indicating the power reserve will be driven at the same time as the oscillating mass 8 turns. It is therefore necessary to compensate for this displacement such that the needle 2 remains immobile relative to the oscillating mass 8 apart, of course, from that relating to the winding up and winding down of the spring barrel.

For compensation of the displacement of the needle 2 for indicating the power reserve inherent to the pivoting of the oscillating mass 8, a differential input moving element, designated in its entirety by the general reference number 26, is provided and is composed of a wheel 28 and a pinion 30. The pinion 30 is integral with the wheel 28 and the thus formed assembly is free in rotation about the differential axle 14. Consequently, when the oscillating mass 8 turns, it causes rotation of the differential input wheel 28 which moves over the toothing of an input crown 32 fixed on the bridges 34 of the movement. By turning, the differential input wheel 28 causes rotation of the differential input pinion 30, which engages with the satellite pinion 20. The latter causes rotation of the satellite wheel 18 which engages with the differential pinion 24 in order finally to cause rotation of the differential axle 14 and therefore of the needle 2 for indicating the power reserve. By allowing the gear ratio for compensation of the displacement of the needle for indicating the power reserve to be equal to −1, in this case, the two input ratios of the output gear 4 and of the crown 32 cancel each other out and the needle 2 for indicating the power reserve remains immobile.

During winding up or winding down of the spring barrel of the watch, the output gear 4 turns in the clockwise direction, respectively anticlockwise direction, and causes rotation of the needle 2 for indicating the power reserve on the oscillating mass 8.

Figure 2:
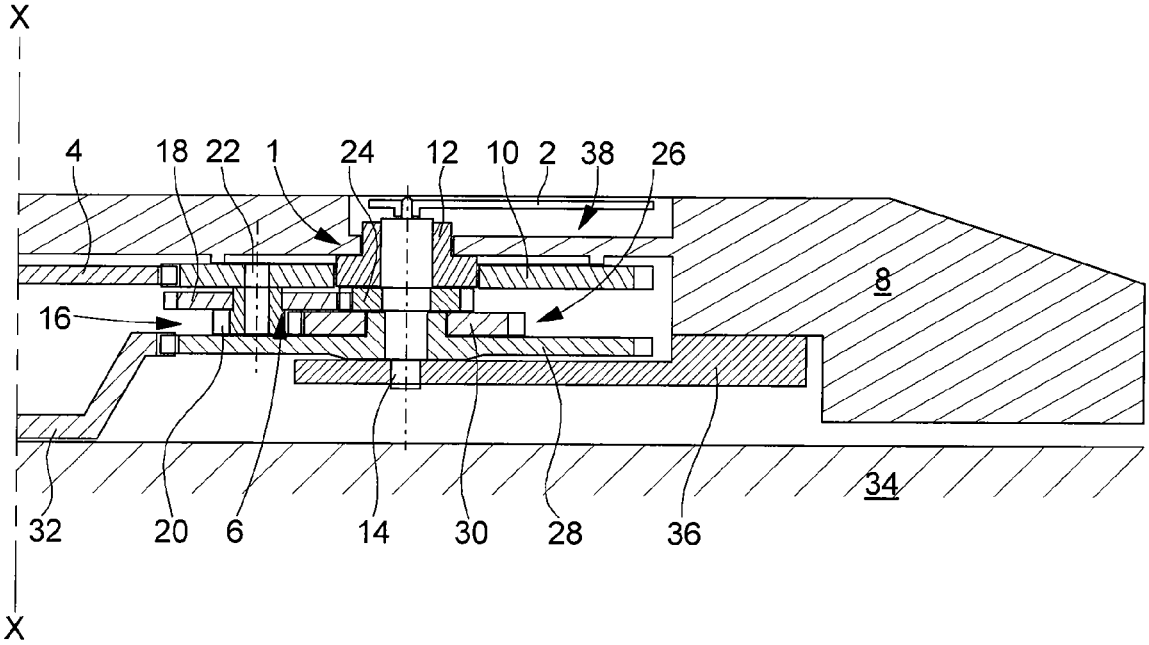
FIG. 2 is a sectional view of the device for indicating the power reserve according to the invention.

It goes without saying that the present invention is not limited to the embodiment, which has just been described, and that various modifications and simple variants can be conceived by the person skilled in the art without departing from the scope of the invention as defined by the annexed claims. In particular, it is conceivable to place intermediate return wheels between the output gear 4 and the differential wheel 10, on the one hand, and between the input crown 32 and the differential input wheel 28, on the other hand, provided that the gear ratios are equal and of opposite signs. It will be noted finally that the differential axle 14 is carried by a limitation bridge 36. In connection with FIGS. 1 and 2, it is seen that the needle 2 for indicating the power reserve is embedded in a hollow 38 provided in the oscillating mass 8.

The invention claimed is:

1. A self-winding watch including an oscillating mass, the movements of which are transmitted to a spring barrel of the watch, and a device for indicating the power reserve comprising means for displaying the power reserve, wherein the means for displaying the power reserve are mounted on the oscillating mass.

2. The self-winding watch according to claim 1, further comprising: differential mechanism with two inputs and one output, a first input being formed by a gear wheel which is connected kinematically to the device for indicating the power reserve, whilst the second input is formed by a mechanism which compensates for the rotation of the display means of the device for indicating the power reserve caused by the rotation of the oscillating mass, the output of the differential mechanism being formed by the means for displaying the power reserve.

3. The self-winding watch according to claim 2, wherein the display means of the device for indicating the power reserve comprise a needle.

4. The self-winding watch according to claim 2, wherein the gear ratios of the gear wheel and of the compensation mechanism are equal and of opposite signs.

5. The self-winding watch according to claim 4, wherein the differential mechanism includes a wheel which is mounted freely about an axle which carries, at one end, the means for displaying the power reserve, the wheel engaging with the gear wheel and carrying a satellite moving element which causes rotation of the axle, the differential mechanism including an input moving element which is in engagement with an input crown which is fixed, and which is caused to rotate by the oscillating mass when the oscillating mass turns, on the other hand, the input moving element causes rotation of the differential axle.

6. The self-winding watch according to claim 5, wherein the display means of the device for indicating the power reserve comprise a needle.

7. The self-winding watch according to claim 4, wherein the display means of the device for indicating the power reserve comprise a needle.

8. The self-winding watch according to claim 1, wherein the display means of the device for indicating the power reserve comprise a needle.

* * * * *